US012202029B2

(12) United States Patent
Watanabe

(10) Patent No.: US 12,202,029 B2
(45) Date of Patent: Jan. 21, 2025

(54) AUTOMATIC TOOL CHANGER AND TOOL CHANGE METHOD

(71) Applicant: AMADA CO., LTD., Kanagawa (JP)

(72) Inventor: Katsumi Watanabe, Kanagawa (JP)

(73) Assignee: AMADA CO., LTD., Kanagawa (JP)

( * ) Notice: Subject to any disclaimer, the term of this patent is extended or adjusted under 35 U.S.C. 154(b) by 552 days.

(21) Appl. No.: 17/615,192

(22) PCT Filed: Apr. 21, 2020

(86) PCT No.: PCT/JP2020/017160
§ 371 (c)(1),
(2) Date: Nov. 30, 2021

(87) PCT Pub. No.: WO2020/226050
PCT Pub. Date: Nov. 12, 2020

(65) Prior Publication Data

US 2022/0314295 A1 Oct. 6, 2022

(30) Foreign Application Priority Data

May 7, 2019 (JP) ..... 2019-087387

(51) Int. Cl.
*B21D 5/02* (2006.01)
*B21D 37/14* (2006.01)
*G05B 19/18* (2006.01)

(52) U.S. Cl.
CPC ..... *B21D 5/0254* (2013.01); *B21D 37/145* (2013.01); *Y10T 483/12* (2015.01); *Y10T 483/136* (2015.01); *Y10T 483/1731* (2015.01)

(58) Field of Classification Search
CPC ..... Y10T 483/1729; Y10T 483/1731; Y10T 483/12–138; B21D 5/0254; B21D 37/145; B21D 5/004; G05B 2219/45143
(Continued)

(56) References Cited

U.S. PATENT DOCUMENTS 6,656,099 B1 12/2003 Akami et al.
6,758,797 B2 7/2004 Akami et al.
(Continued)

FOREIGN PATENT DOCUMENTS

EP 1160024 A1 12/2001
EP 1925374 A1 5/2008
(Continued)

OTHER PUBLICATIONS

Machine Translation of JP 07-100540 A, which JP '540 was published Apr. 1995.*
(Continued)

*Primary Examiner* — Erica E Cadugan
(74) *Attorney, Agent, or Firm* — Renner, Otto, Boisselle & Sklar, LLP

(57) ABSTRACT

An automatic tool changer includes first and second tool change units that is driven respectively by a pair of servo motors and move along an arrangement direction of a plurality of tools installed on a tool installation unit, a torque detection unit that detects a torque of each of the pair of servo motors, and a control device that controls operations of the first and second tool change units. The control device fixes the first tool change unit at a reference position, and moves the second tool change unit toward the first tool change unit. The control device determines, based on a torque change of each servo motor, that a plurality of upper tools are brought together at the first tool change unit as a result of a movement of the second tool change unit.

2 Claims, 6 Drawing Sheets

(58) Field of Classification Search
USPC ..... 483/28–29, 1, 4–11; 700/179, 165
See application file for complete search history.

(56) References Cited

U.S. PATENT DOCUMENTS

| | | | | |
|---|---|---|---|---|
| 6,780,145 | B2 | 8/2004 | Akami et al. | |
| 6,843,760 | B2 | 1/2005 | Akami et al. | |
| 7,029,429 | B2 | 4/2006 | Akami et al. | |
| 8,001,824 | B2 | 8/2011 | Akami et al. | |
| 9,599,738 | B2 | 3/2017 | Gondo et al. | |
| 12,070,789 | B2 * | 8/2024 | Onagi | B21D 5/0254 |
| 2003/0064871 | A1 | 4/2003 | Akami | |
| 2003/0069114 | A1 | 4/2003 | Akami | |
| 2003/0092547 | A1 | 5/2003 | Akami | |
| 2004/0157715 | A1 | 8/2004 | Akami | |
| 2009/0100896 | A1 | 4/2009 | Akami et al. | |
| 2015/0160361 | A1 | 6/2015 | Gondo et al. | |
| 2015/0174633 | A1 * | 6/2015 | Sato | B30B 15/028 700/214 |
| 2021/0245222 | A1 | 8/2021 | Watanabe | |
| 2022/0203429 | A1 * | 6/2022 | Sato | B21D 5/02 |
| 2022/0234088 | A1 * | 7/2022 | Onagi | B21D 5/004 |
| 2022/0388052 | A1 * | 12/2022 | Onagi | B21D 5/004 |

FOREIGN PATENT DOCUMENTS

| | | | |
|---|---|---|---|
| EP | 2868401 | A1 | 5/2015 |
| JP | 6-190449 | A | 7/1994 |
| JP | 7-100540 | A | 4/1995 |
| JP | 09-295059 | A | 11/1997 |
| JP | 2000-71028 | A | 3/2000 |
| JP | 2001-150032 | A | 6/2001 |
| JP | 2006-346707 | A | 12/2006 |
| JP | 4672868 | B2 | 4/2011 |
| JP | 2014-91137 | A | 5/2014 |
| JP | 2019-214061 | A | 12/2019 |
| WO | 2016/109862 | A1 | 7/2016 |

OTHER PUBLICATIONS

Extended European Search report for corresponding EP Application No. 23179279.7 issued Sep. 18, 2023.
International Search Report for corresponding Application No. PCT/JP2020/017160, mailed Jul. 28, 2020.
Written Opinion for corresponding Application No. PCT/JP2020/017160, mailed Jul. 28, 2020.
Extended European Search report for corresponding EP Application No. 20802965.2 issued May 30, 2022.

* cited by examiner

AUTOMATIC TOOL CHANGER AND TOOL CHANGE METHOD

TECHNICAL FIELD

The present disclosure relates to an automatic tool changer and a tool change method.

BACKGROUND ART

A press brake is a processing machine that performs bending of a material such as a sheet metal by using tools installed on tool installation units of upper and lower tales. Among press brakes, a press brake is known that is equipped with an automatic tool changer (also referred to as an ATC) for automatically performing tool change between a tool storage unit that stores the tools and a tool installation unit (see, for example, Patent Literatures 1 and 2).

Further, Patent Literature 3 discloses a bending machine provided with a back gauge for positioning a material. In Patent Literature 3, a technique is disclosed in which a side gauge attached to an abutment of the back gauge is moved and brought into contact with a punch or a die so that a position of the punch or the die is detected.

CITATION LIST

Patent Literature

Patent Literature 1: Japanese Patent Application Laid-Open Publication No. 2000-71028

Patent Literature 2: Japanese Patent Application Laid-Open Publication No. 2014-91137

Patent Literature 03: Japanese Patent Application Laid-Open Publication No. H09-295059

SUMMARY

In some cases, when a tool placement by the automatic change fails due to a warning or a halfway termination, or when the tool is unclamped by an operation other than the automatic change, the tool position may be shifted. Since it is not possible to identify where the tool is located in the tool installation unit, there arises such a problem that the tool cannot be automatically stored by the automatic tool changer.

The present disclosure has been made in view of such circumstances, and an object of the present disclosure is to provide an automatic tool changer and a tool change method capable of recognizing a tool position even when the tool position is shifted.

According to a first aspect of one or more embodiments, an automatic tool changer for storing, in a tool storage unit, a plurality of tools installed side by side on a tool installation unit of a press brake is provided. The present automatic tool changer includes a pair of servo motors, first and second tool change units configured to be driven respectively by the pair of servo motors and move along an arrangement direction of the tools on the tool installation unit, a torque detection unit configured to detect a torque of each of the pair of servo motors, and a control device configured to control operations of the pair of the tool change units, in which the control device is configured to fix the first tool change unit at a predetermined reference position, move the second tool change unit toward the first tool change unit, and determine, based on a torque change of each of the servo motors detected by the torque detection unit, that the plurality of tools are brought together at the first tool change unit as a result of a movement of the second tool change unit.

Further, according to a second aspect of the one or more embodiments, a tool change method is provided by which a plurality of tools installed side by side on a tool installation unit of a press brake are stored in a tool storage unit. The present tool change method includes placing a fixing unit configured to regulate a movement of the tool at a reference position, moving the plurality of tools installed on the tool installation unit to one side along an arrangement direction of the tools on the tool installation unit, and bringing the plurality of tools together at the fixing unit.

According to the present disclosure, it is possible to recognize a tool position even when the tool position is shifted.

DESCRIPTION OF EMBODIMENT

Figure 1:
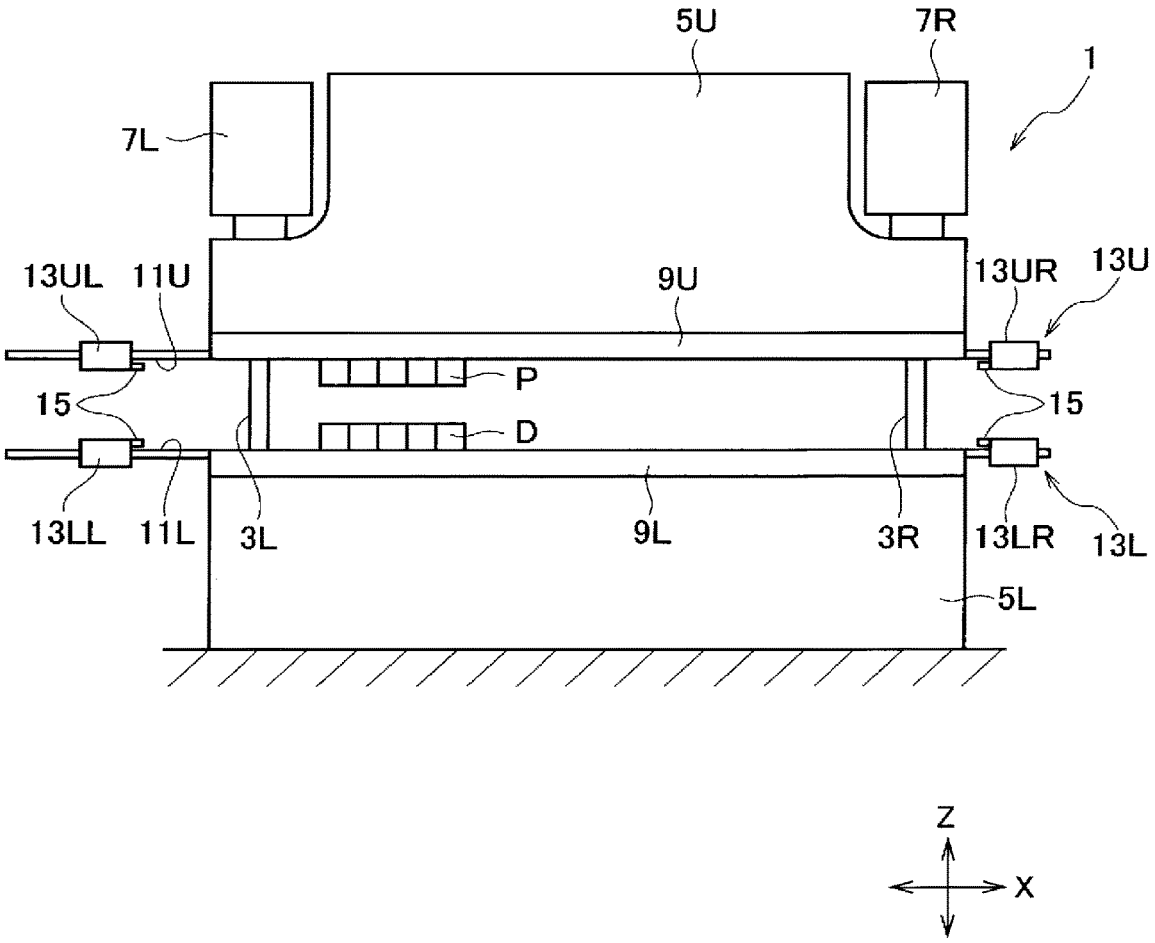
FIG. 1 is a front view schematically showing a configuration of a press brake including an automatic tool changer according to an embodiment.
Figure 2:
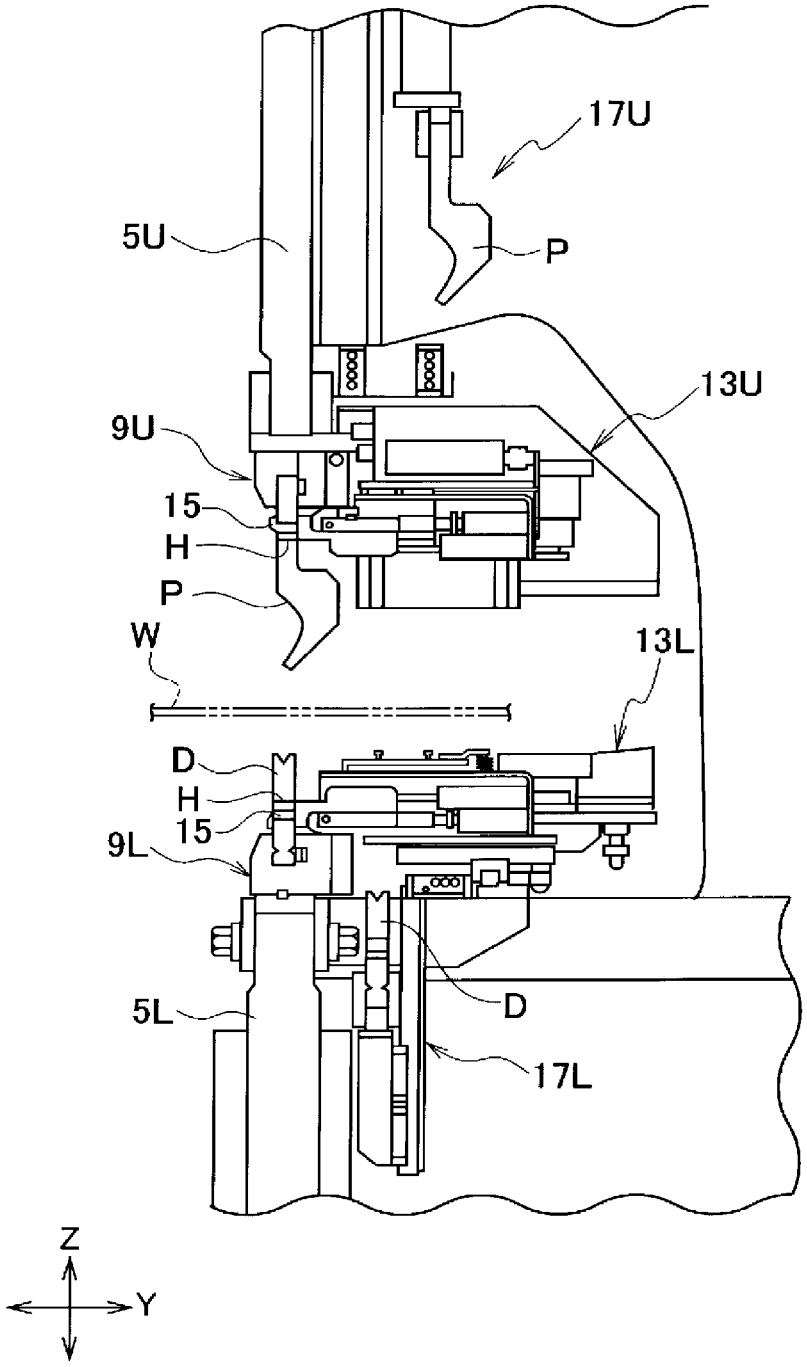
FIG. 2 is a cross-sectional view schematically showing the configuration of the press brake including the automatic tool changer according to the present embodiment.

Hereinafter, a press brake including an automatic tool changer according to an embodiment will be described. In FIG. 1 or 2, a press brake 1 is a processing machine that performs bending of a material W such as a sheet metal by a pair of tools. The press brake 1 includes an upper table 5U, a lower table 5L, and automatic tool changers/tool movement regulators 13U and 13L.

The upper table 5U is provided above left and right side frames 3L and 3R. The upper table 5U is moved up and down by hydraulic cylinders 7L and 7R provided on the left and right. The lower table 5L is provided below the side frames 3L and 3R in such a manner as to face the upper table 5U in the vertical direction (Z-axis direction).

The upper table 5U is provided with a tool installation unit/tool installation 9U on which an upper tool P is installed. The tool installation unit 9U extends in the left-right direction (X-axis direction). Depending on a layout of the tools to be used for the bending, a required number of tool stages in which one or more upper tools P are combined are installed side by side on the tool installation unit 9U. When the press brake 1 is viewed from the front, the upper tools P installed on the tool installation unit 9U are arranged side by side along the left-right direction.

A guide member 11U extending in the left-right direction is provided on the rear side (back side in the Y-axis direction) of the upper table 5U. The guide member 11U is provided with the automatic tool changer 13U. The automatic tool changer 13U changes the upper tool P between a tool storage unit 17U on the rear side of the upper table 5U and the tool installation unit 9U. Changing of the tool includes storing the upper tool P into the tool storage unit 17U, taking out the upper tool P from the tool storage unit 17U, installing the upper tool P on the tool installation unit 9U, and taking out the upper tool P from the tool installation unit 9U.

The automatic tool changer 13U includes the left and right (a pair of) tool change units 13UL and 13UR. The respective tool change units 13UL and 13UR are configured to be movable in the left-right direction along the guide member 11U. The pair of tool change units 13UL and 13UR are respectively driven by individual servo motors.

The tool change units 13UL and 13UR are each provided with a tool holding member (finger) 15 for holding the upper tool P by engaging with an engagement hole H provided in the tool (upper tool P). The tool holding member 15 is configured to be movable forward and backward in the front-rear direction (Y-axis direction) so as to engage with the engagement hole H and disengage from the engagement hole H.

When holding the upper tool P installed on the tool installation unit 9U, the tool change units 13UL and 13UR are moved in the left-right direction so as to be positioned on the rear side of the upper tool P to be held. When the tool holding member 15 is switched to a forward movement state, the tool holding member 15 is inserted into the engagement hole H.

Further, the tool holding member 15 can cause the upper tool P to move in the left-right direction along the tool installation unit 9U. Specifically, the tool holding member 15 is switched to the forward movement state when the upper tool P does not exist in front of the tool holding member 15. When the tool change units 13UL and 13UR move in the left-right direction, the tool holding member 15 in the forward movement state abuts on an end portion of the upper tool P in the left-right direction. When the tool change units 13UL and 13UR continue to move in the left-right direction, an external force for moving the upper tool P is applied, which moves the upper tool P in the left-right direction.

Similar to the upper table 5U, the lower table 5L is provided with a tool installation unit 9L as well on which a lower tool D is installed. The configuration of the tool installation unit 9L is the same as that of the tool installation unit 9U.

A guide member 11L extending in the left-right direction is provided on the rear side (back side in the Y-axis direction) of the lower table 5L, and the guide member 11L is provided with an automatic tool changer 13L. The automatic tool changer 13L changes the lower tool D between a tool storage unit 17L on the rear side of the lower table 5L and the tool installation unit 9L. This automatic tool changer 13L includes a pair of tool change units 13LL and 13LR. The configuration of the automatic tool changer 13L is the same as that of the automatic tool changer 13U, and detailed description thereof will be omitted.

Figure 3:
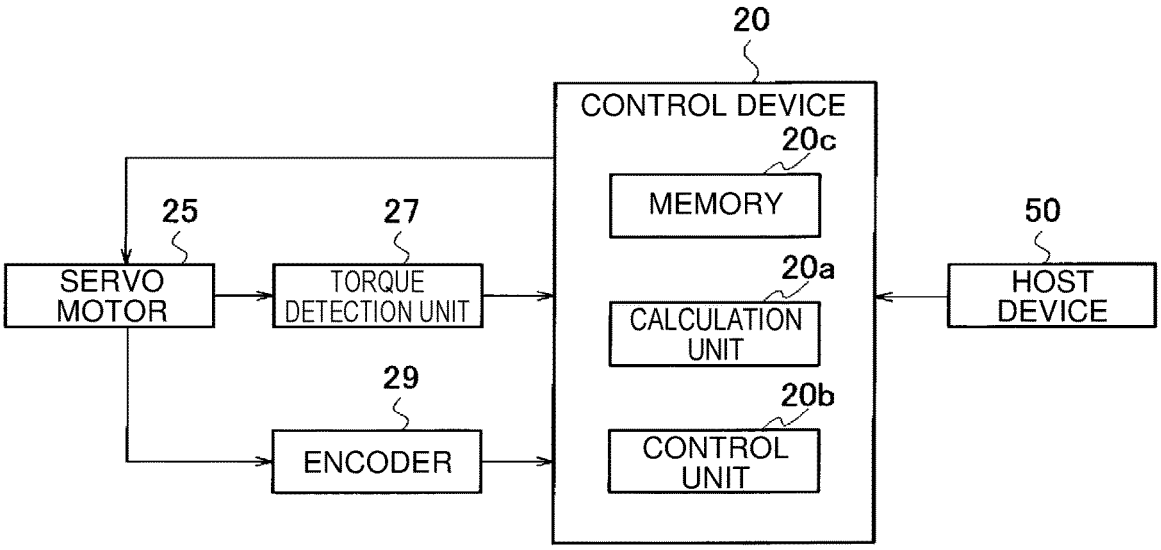
FIG. 3 is a block diagram showing a configuration of a control device of the automatic tool changer according to the present embodiment.

In FIG. 3, a control device 20 controls operations of the automatic tool changers 13U and 13L. The control device 20 is mainly configured with a CPU, a ROM, a RAM, and an I/O interface. The control device 20 controls the operations of the automatic tool changers 13U and 13L when the CPU reads out various programs according to the processing contents from the ROM or the like, develops the various programs in the RAM, and executes the developed various programs.

The control device 20 supplies each servo motor 25 with a control command for controlling the servo motor 25. Further, detection signals are supplied to the control device 20 from a torque detection unit 27 that detects a torque of each servo motor 25 and an encoder 29 that detects a rotation speed of the servo motor 25, respectively. Note that the servo motor 25, the torque detection unit 27, and the encoder 29 are provided corresponding to the four tool change units 13UL, 13UR, 13LL, and 13LR, respectively, but only one set of configurations is representatively shown in FIG. 3.

Further, a host device 50 is connected to the control device 20. The host device 50 is, for example, an NC device that controls the press brake 1, and the control device 20 can acquire necessary information from the host device 50.

The control device 20 functionally has a calculation unit 20*a*, a control unit 20*b*, and a memory 20*c*.

The calculation unit 20*a* monitors the torque of the servo motor 25 based on the detection signal supplied from the torque detection unit 27.

The control unit 20*b* controls the servo motor 25 to control the position of each of the tool change units 13UL, 13UR, 13LL, and 13LR. In this position control, the control unit 20*b* can recognize the position of each of the tool change units 13LL, 13LR, 13UL, and 13UR in the left-right direction based on the detection signal supplied from the encoder 29. Further, in addition to the position control, the control unit 20*b* also controls a forward and backward operation of the tool holding member 15 carried by each of the tool change units 13UL, 13UR, 13LL, and 13LR, and a movement of each of the tool change units 13UL, 13UR, 13LL, and 13LR required for tool change.

The memory 20*c* stores various information. The memory 20*c* stores information on a torque threshold value for determining a torque change of each servo motor 25. The memory 20*c* stores information on a reference position.

The memory 20*c* stores a tool ID for identifying each tool (the upper tool P and the lower tool D) owned by the press brake 1, and storage information indicating correspondence with a storage position in the tool storage units 17U and 17L.

Figure 4:
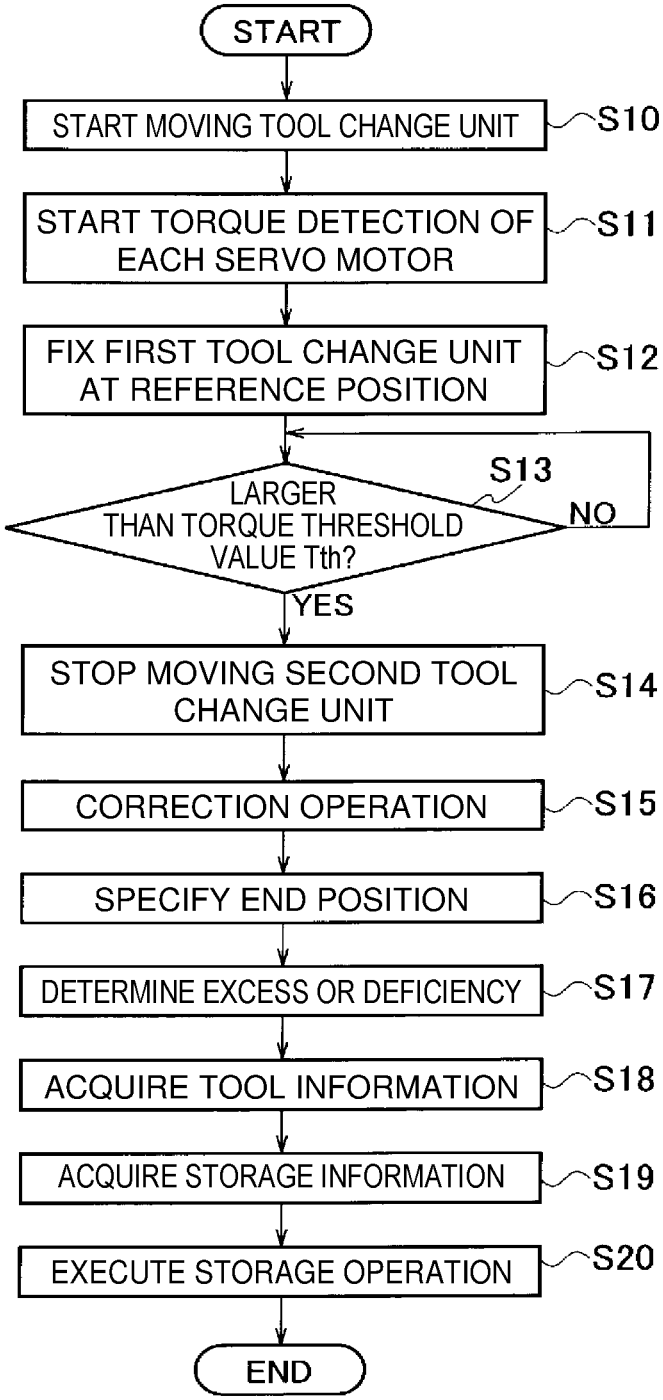
FIG. 4 is a flowchart showing a tool change procedure.

Hereinafter, a tool change procedure by the automatic tool changers 13U and 13L will be described with reference to FIGS. 4 to 6. This tool change procedure is a procedure for storing, into the tool storage unit 17U or 17L, the upper tool P or the lower tool D in an unclamped state on the tool installation unit 9U or 9L, and the tool change procedure is carried out by the control device 20.

Note that in the following description, an operation of the automatic tool changer 13U corresponding to the upper table 5U will be described, but an operation of the automatic tool changer 13L corresponding to the lower table 5L is also the same. Further, of the pair of tool change units 13UL and 13UR, one tool change unit 13UL located on the left side of FIG. 1 is referred to as a first tool change unit 13UL, and the other tool change unit 13UR located on the right side of FIG. 1 is referred to as a second tool change unit 13UR. It is assumed that a plurality of upper tools, for example, four upper tools P1 to P4 are installed on the tool installation unit 9U.

In performing this procedure, as shown in FIG. 1, the control unit 20*b* arranges the pair of tool change units 13UL and 13UR at initial positions. The left end portion of the guide member 11U is the initial position of the first tool change unit 13UL, and the right end portion of the guide member 11U is the initial position of the second tool change unit 13UR. In a state in which the first tool change unit 13UL and the second tool change unit 13UR are arranged at the initial positions thereof, the four upper tools P1 to P4 exist between the first tool change unit 13UL and the second tool change unit 13UR.

Figure 5A:
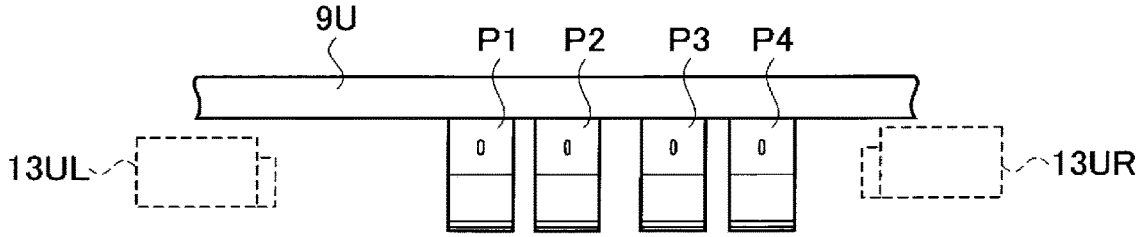
FIG. 5A is an explanatory diagram showing an operation of a tool change unit.

First, in step S10, the control unit 20*b* starts moving the first tool change unit 13UL and the second tool change unit 13UR. Specifically, the control unit 20*b* controls the servo motor 25 for driving the first tool change unit 13UL so that the first tool change unit 13UL is moved toward the right side, that is, toward the second tool change unit 13UR (FIG. 5A). Similarly, the control unit 20*b* controls the servo motor 25 for driving the second tool change unit 13UR so that the second tool change unit 13UR is moved toward the left side, that is, toward the first tool change unit 13UL (FIG. 5A).

In step S11, the calculation unit 20*a* starts torque detection of the servo motors 25 based on the detection signal supplied from the torque detection unit 27. The torque detection is performed on each of the servo motor 25 for driving the first tool change unit 13UL and the servo motor 25 for driving the second tool change unit 13UR.

Figure 6:
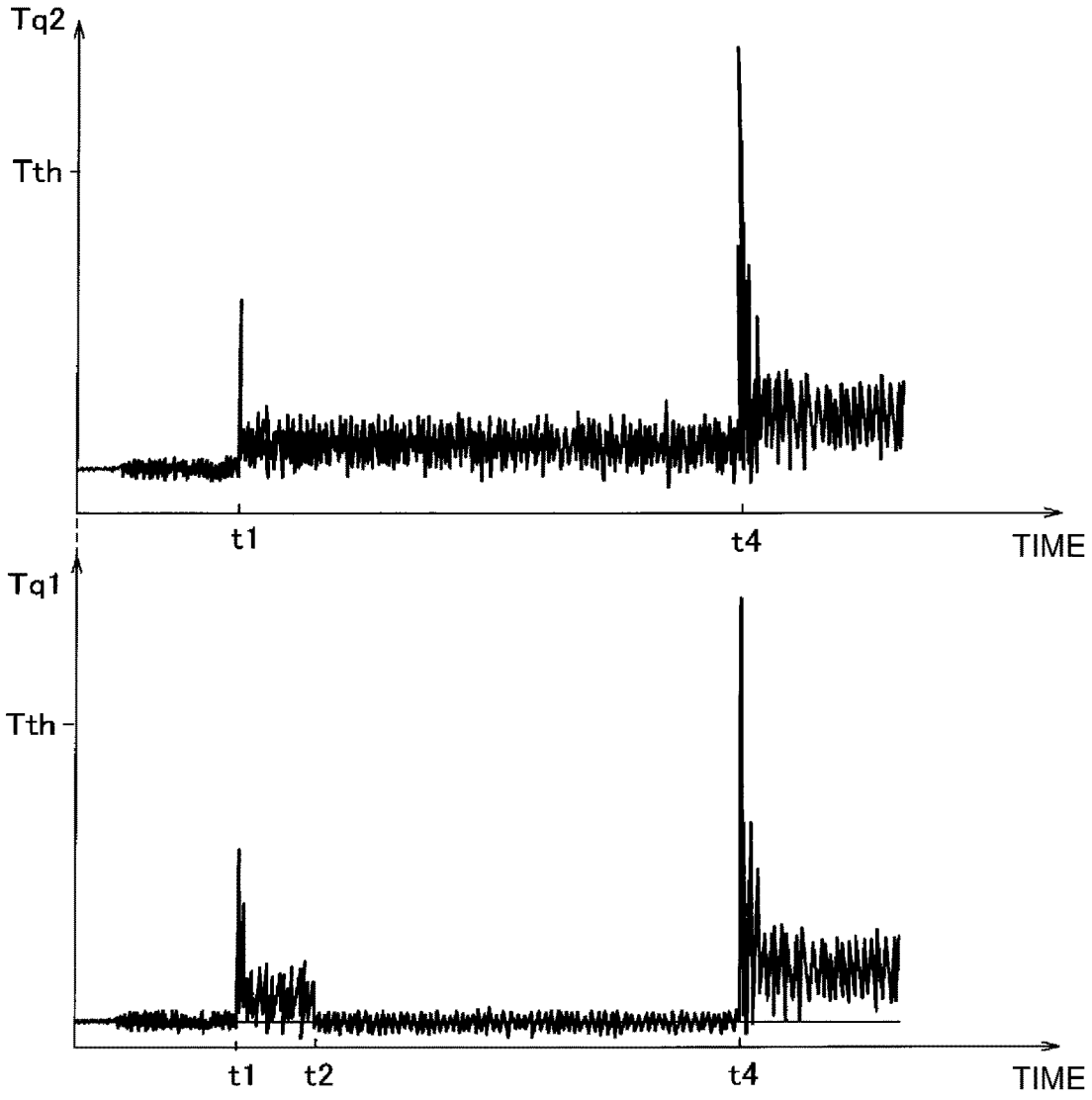
FIG. 6 is an explanatory diagram showing transitions of torques of servo motors.

Here, in FIG. 6, "Tq1" indicates a torque of the servo motor 25 for the first tool change unit 13UL, and "Tq2" indicates a torque of the servo motor 25 for the second tool change unit 13UR. In FIG. 6, "t1" is a time at which movement of the first tool change unit 13UL and the second tool change unit 13UR are started.

Figure 5B:
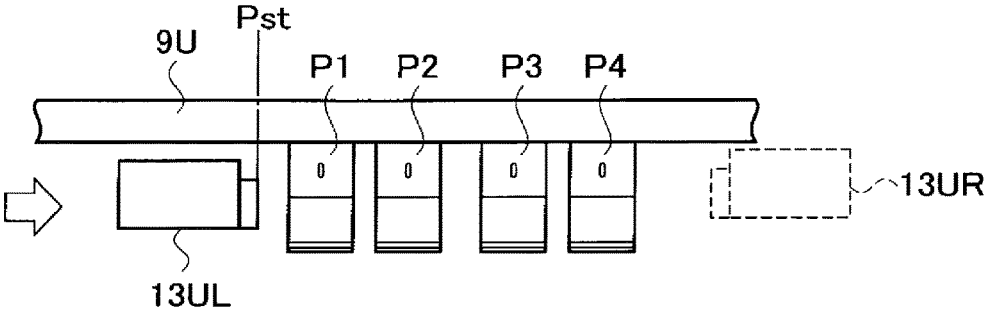
FIG. 5B is an explanatory diagram showing an operation of the tool change unit.

In step S12, the control unit 20*b* outputs a stop command to the servo motor 25 for the first tool change unit 13UL so that the first tool change unit 13UL is stopped and fixed at a reference position Pst (FIG. 5B, a time t2 in FIG. 6). The reference position Pst is set in advance to the right side of the initial position of the first tool change unit 13UL, that is, a predetermined position closer to the second tool change unit 13UR. The control unit 20*b* refers to the position of the first tool change unit 13UL specified by the encoder 29, and determines whether or not the first tool change unit 13UL has reached the reference position Pst.

Figure 5C:
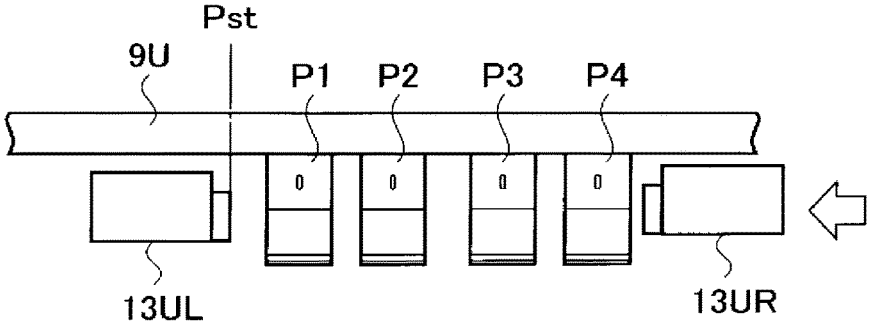
FIG. 5C is an explanatory diagram showing an operation of the tool change unit.

On the other hand, the second tool change unit 13UR continues to move toward the first tool change unit 13UL (FIG. 5C). When the second tool change unit 13UR continues to move, the second tool change unit 13UR abuts on the upper tool P4 located on the far right side. The upper tool P4 is pushed by the second tool change unit 13UR, which causes the upper tool P4 to be moved toward the first tool change unit 13UL. By repeating this operation, the upper tool P3, the upper tool P2, and the upper tool P1 are pushed one after another by the second tool change unit 13UR. Finally, the four upper tools P1 to P4 are moved to the first tool change unit 13UL in a state of being in close contact with each other.

In step S13, the calculation unit 20*a* determines whether or not the torques Tq1 and Tq2 of the respective servo motors 25 are larger than a torque threshold value Tth. The first tool change unit 13UL is fixed at the reference position Pst. Therefore, when the four upper tools P1 to P4 are brought together at the first tool change unit 13UL, the second tool change unit 13UR can no longer move the four upper tools P1 to P4. The servo motor 25 for the second tool change unit 13UR becomes overloaded, and a large torque change is generated (a time t4 in FIG. 6).

Further, in the present embodiment, the first tool change unit 13UL is fixed at the reference position Pst. Therefore, when the four upper tools P1 to P4 moved by the second tool change unit 13UR abut on the first tool change unit 13UL, a large torque change also occurs in the servo motor 25 for the first tool change unit 13UL (a time t4 in FIG. 6).

The torque threshold value Tth is for identifying an excessive torque generated in each servo motor 25 when the upper tools P1 to P4 are brought together at the first tool change unit 13UL. An optimum value obtained through experiments and simulations is set to the torque threshold value Tth, which is stored in the memory 20*c*.

In other words, in step S13, the calculation unit 20*a* compares the torques Tq1 and Tq2 from the respective servo motors 25 with the torque threshold value Tth, so as to determine whether or not the four upper tools P1 to P4 are brought together at the first tool change unit 13UL as a result of a movement of the second tool change unit 13UR. If a positive determination is made in step S13, that is, if the torques Tq1 and Tq2 of the respective servo motors 25 are larger than the torque threshold value Tth, a positive determination is made in step S13 and the process proceeds to step S14. On the other hand, if a negative determination is made in step S13, that is, if the torques Tq1 and Tq2 of both or one of the servo motors 25 are equal to or less than the torque threshold value Tth, a negative determination is made in step S13 and the process returns to step S13.

In step S14, the control unit 20*b* outputs a stop command to the servo motor 25 for the second tool change unit 13UR so that the second tool change unit 13UR is stopped. This processing in the step S14 is executed by the positive determination in step S13, that is, a determination that the four upper tools P1 to P4 are brought together at the first tool change unit 13UL as a result of the movement of the second tool change unit 13UR.

In some cases, even if the stop command is output to the servo motor 25, the servo motor 25 may not stop immediately and thus the second tool change unit 13UR may advance by inertia. This results in a state in which the four upper tools P1 to P4 are pushed together by the second tool change unit 13UR. In this case, vibrations of the upper tools P1 to P4 may be transmitted to the servo motor 25 and regarded as an abnormality of the servo motor 25. In addition, there is a possibility that an end position Peg, which will be described later, cannot be recognized correctly.

Therefore, in step S15, the control unit 20*b* performs a correction operation, specifically, an operation of causing the second tool change unit 13UR to travel in the reverse direction by a predetermined amount. Specifically, the control unit 20*b* calculates, based on the moving speed of the second tool change unit 13UR and the weights of the upper tools P1 to P4, an amount of inertia movement in which the second tool change unit 13UR moves by inertia after the stop command. Then, the control unit 20*b* controls the servo motor 25 so as to cause the second tool change unit 13UR to travel in the reverse direction by the amount of inertia movement. Note that this correction operation may be performed when the first tool change unit 13UL is stopped.

Figure 5D:
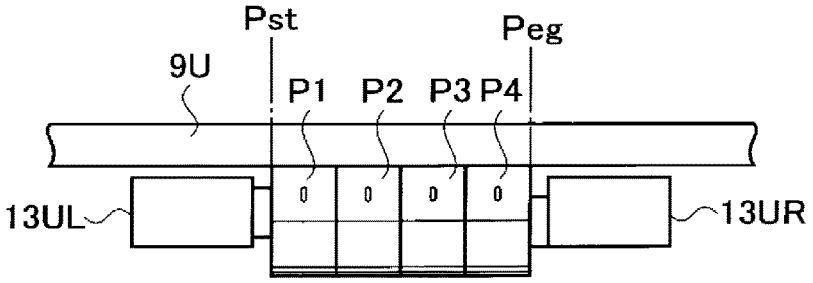
FIG. 5D is an explanatory diagram showing an operation of the tool change unit.

In step S16, the control unit 20*b* refers to the detection signal from the encoder 29 and specifies a stop position of the second tool change unit 13UR. Then, the control unit 20*b* specifies the end position Peg of the four upper tools P1 to P4 based on the stop position of the second tool change unit 13UR (FIG. 5D). The end position Peg corresponds to a boundary surface between the upper tool P4 located closest to the second tool change unit 13UR and the second tool change unit 13UR.

In step S17, the calculation unit 20*a* determines any excess or deficiency of the tool with respect to the upper tools P1 to P4 that have been brought together. If any of the upper tools P1 to P4 is manually removed, a difference is produced between the length from the reference position Pst to the end position Peg and the total sum of the divided lengths of the upper tools P1 to P4 that should be on the tool installation unit 9U.

Then, the calculation unit 20*a* acquires layout information from, for example, the host device 50. This layout information defines a layout of the tools to be used for the bending, and indicates information of the upper tools that should be on the tool installation unit 9U. The layout information includes information on the tool ID, a divided length, an installation position, and the like.

The calculation unit 20*a* calculates the total sum of the divided lengths of the four upper tools P1 to P4 based on the layout information. When the length from the reference position Pst to the end position Peg coincides with the total sum of the divided lengths of the upper tools P1 to P4, the calculation unit 20*a* determines that there is no excess or deficiency of the tool. On the other hand, if the length from the reference position Pst to the end position Peg does not coincide with the total sum of the divided lengths of the upper tools P1 to P4, the calculation unit 20*a* determines that there is some excess or deficiency of the tool.

In step S18, the calculation unit 20*a* acquires tool information. The tool information is information on the four upper tools P1 to P4 that have been brought together, in which the tool ID is associated with an arrangement order of the tool from the end position Peg for each of the four upper tools P1 to P4. The calculation unit 20*a* can acquire the tool information based on information generated by a user from the four upper tools P1 to P4 that have been brought together. The calculation unit 20*a* can acquire the information generated by the user via, for example, the host device 50. Further, when a device/acquirer capable of automatically acquiring the tool ID and the arrangement order of the tool from the end position Peg is provided for each of the four upper tools P1 to P4 that have been brought together, the tool information can be acquired through this device/acquirer. Further, if there is no excess or deficiency of the tool, the calculation unit 20*a* can also acquire the tool information from the layout information described above.

In step S19, the calculation unit 20*a* acquires the storage information from the memory 20*c*.

In step S20, the calculation unit 20*a* controls one or both of the tool change units 13UL and 13UR and executes a storage operation of picking up the four upper tools P1 to P4, which have been brought together, in order starting with the upper tool closest to the end position Peg so as to be stored in the tool storage positions.

Specifically, the calculation unit 20*a* specifies, based on the tool information and the storage information, the tool storage positions in which the four upper tools P1 to P4 are stored, respectively. The tool storage position is specified with reference to the tool ID.

The calculation unit 20*a* determines the upper tools P1 to P4 to be stored according to the arrangement order of the upper tools P1 to P4 from the end position Peg. The first one to be stored is the upper tool P4 at the end position Peg, followed by the upper tools P3, the upper tool P2, and the upper tool P1. These upper tools P1 to P3 are to be stored in this order.

In this case, the calculation unit 20*a* can specify, based on the end position Peg and the divided lengths of the upper tools P1 to P4, the end position of the upper tools P1 to P4 to be stored (the boundary positions with the adjacent tools). For example, the end position of the upper tool P4 is the above-mentioned end position Peg, and the end position of the upper tool P3 is a position shifted to the left by the divided length of the upper tool P4 from the above-mentioned end position Peg. The end position of the upper tool P2 is a position shifted to the left by the divided lengths of the upper tools P4 and P3 from the above-mentioned end position Peg, and the end position of the upper tool P1 is a position shifted to the left by the divided lengths of the upper tools P4, P3, and P2 from the above-mentioned end position Peg.

Further, the engagement holes H for holding the upper tools P1 to P4 are provided at the centers of the upper tools P1 to P4 in the left-right direction. Therefore, the calculation unit 20*a* specifies, based on the end position of the upper tools P1 to P4 to be stored and the divided lengths of the tools, holding positions at which the upper tools P1 to P4 to be stored are held by the tool change units 13UR and 13UL.

Then, the control unit 20*b* controls the tool change units 13UR and 13UL based on the holding positions thereof, and removes the upper tools P1 to P4 to be stored from the tool installation unit 9U. Then, the control unit 20*b* controls the tool change units 13UR and 13UL to store the upper tools P1 to P4 in the tool storage positions of the tool storage unit 17U.

When such storage operations are performed on all of the four upper tools P1 to P4, the series of procedures are completed.

As described above, the automatic tool changer 13U according to the present embodiment includes the pair of servo motors 25, the first and second tool change units 13UL and 13UR configured to be driven respectively by the pair of servo motors 25 and move along the arrangement direction of the tools of the tool installation unit 9U, a torque detection unit 27 configured to detect a torque of each of the pair of servo motors 25, and a control device 20 configured to control the operations of the first and second tool change units 13UL and 13UR. Then, the control device 20 fixes the first tool change unit 13UL at the predetermined reference position Pst, moves the second tool change unit 13UR toward the first tool change unit 13UL, and determines, based on the torque change of each servo motor 25 detected by the torque detection unit 27, that the plurality of upper tools P1 to P4 are brought together at the first tool change unit 13UL as a result of the movement of the second tool change unit 13UR.

According to this configuration, by sandwiching the plurality of upper tools P1 to P4 between the first tool change unit 13UL and the second tool change unit 13UR, the upper tools P1 to P4 can be brought together at the first tool change unit 13UL. Further, since the first tool change unit 13UL is fixed at the reference position Pst, it is possible to accurately determine that the plurality of upper tools P1 to P4 are brought together at the first tool change unit 13UL by paying attention to the torque change of each servo motor 25. In this manner, even if the tool position is shifted and the position thereof cannot be recognized correctly, it is possible to recognize the positions of the plurality of upper tools P1 to P4 by putting the plurality of upper tools P1 to P4 together with respect to the first tool change unit 13UL that is at the reference position Pst.

Further, in the present embodiment, the control device 20 specifies the end position Peg of the plurality of upper tools P1 to P4 that have been brought together based on the torque change of each servo motor 25 detected by the torque detection unit 27 and the position of the second tool change unit 13UR.

According to this configuration, since the end position Pegs of the plurality of upper tools P1 to P4 can be specified, the positions of the plurality of upper tools P1 to P4 can be recognized between the reference position Pst and the end position Pegs.

Further, in the present embodiment, the control device 20 determines excess or deficiency of the tool based on the layout information of the tools to be installed on the tool installation unit 9U and the length from the reference position Pst to the end position Peg.

According to this configuration, even if any of the upper tools P1 to P4 is manually removed, this fact can be appropriately determined. As a result, the statuses of the upper tools P1 to P4 installed on the tool installation unit 9U can be appropriately grasped.

Further, in the present embodiment, the control device 20 acquires the tool information in which the tool ID for identifying the tool is associated with the arrangement order of the tool from the end position Peg for each of the plurality upper tools P1 to P4 that have been brought together. Similarly, the control device 20 acquires the storage information in which the tool ID is associated with the tool storage position in the tool storage unit 17U. Then, the control device 20 specifies, based on the tool information and the storage information, the tool storage position for each of the plurality of upper tools P1 to P4 that have been brought together.

According to this configuration, the tool storage position can be specified for each of the plurality of upper tools P1 to P4 that have been brought together. Thereby, the upper tools P1 to P4 can be stored into the tool storage unit 17U.

Further, in the present embodiment, the control device 20 controls one or both of the pair of tool change units 13UL and 13UR and executes the storage operation of picking up the upper tools P1 to P4 in order starting with the upper tool closest to the end position Peg so as to be stored in the tool storage positions.

According to this configuration, the plurality of upper tools P1 to P4 can be automatically stored by using the pair of tool change units 13UL and 13UR.

Further, in the present embodiment, the control device 20 determines the upper tools P1 to P4 to be stored according to the arrangement order of the upper tools P1 to P4 from the end position Peg, and specifies the holding positions at which the tools are held by the tool change units 13UL and 13UR based on the end position of the upper tools P1 to P4 to be stored and the divided lengths of the tools. Further, the control device 20 picks up, from the tool installation unit 9U, the tools to be stored based on the holding positions thereof so as to be stored in the tool storage positions.

According to this configuration, the upper tools P1 to P4 can be appropriately held. Thereby, the upper tools P1 to P4 on the tool installation unit 9U can be reliably picked up and stored in the tool storage positions.

Further, in the present embodiment, the control device 20 determines that the plurality of upper tools P1 to P4 are brought together when the torque Tq2 of the servo motor 25 for driving the second tool change unit 13UR is equal to or higher than the torque threshold value Tth.

When the plurality of upper tools P1 to P4 are brought together at the fixed first tool change unit 13UL, the movement of the second tool change unit 13UR is forcibly regulated. In this case, the servo motor 25 for driving the second tool change unit 13UR becomes overloaded, and a large torque change is generated. By comparing the torque Tq2 of the servo motor 25 with the torque threshold value Tth, the torque change can be specified. As a result, it can be appropriately determined that the plurality of upper tools P1 to P4 are brought together.

Further, in the present embodiment, the control device 20 determines that the plurality of upper tools P1 to P4 are brought together when not only the torque Tq2 of the servo motor 25 for driving the second tool change unit 13UR but also the torque Tq of the servo motor 25 for driving the first tool change unit 13UL are equal to or higher than the torque threshold value Tth.

When the plurality of upper tools P1 to P4 are brought together at the fixed first tool change unit 13UL, a force from the second tool change unit 13UR that pushes these upper tools P1 to P4 also acts on the first tool change unit 13UL. In this case, a large torque change is also generated in the servo motor 25 for driving the first tool change unit 13UL. Therefore, by using the torques Tq1 and Tq2 of both of the servo motors 25, it is possible to reliably determine the state in which the plurality of upper tools P1 to P4 are brought together.

Further, in the present embodiment, the control device 20 outputs the stop command for stopping the second tool change unit 13UR when the plurality of upper tools P1 to P4 are brought together at the first tool change unit 13UL. Further, the control device 20 calculates the amount of inertia movement in which the second tool change unit 13UR moves by inertia after the stop command is output based on the moving speed of the second tool change unit 13UR and the weights of the plurality of upper tools P1 to P4. Then, the control device 20 causes the second tool change unit 13UR to travel in the reverse direction based on the amount of inertia movement.

Even if the second tool change unit 13UR is stopped, the stop position may be shifted due to inertia. This results in a state in which the plurality of upper tools P1 to P4 are pushed by the second tool change unit 13UR, vibrations and the like of the tools may be regarded as an abnormality of the servo motor 25. In this respect, it is possible to cause the second tool change unit 13UR to travel in the reverse direction, and to return the second tool change unit 13UR to an original stop position.

In addition, since the state in which the second tool change unit 13UR is at the position at which the tools remain pushed can be eliminated, the position shift of the second tool change unit 13UR can be suppressed. Thereby, the automatic tool change can be performed appropriately.

Further, the tool change method according to an embodiment is a method of storing, in the tool storage unit 17U, the plurality of tools installed side by side on the tool installation unit 9U of the press brake 1. In this tool change method, the fixing unit for regulating the movement of the upper tools P1 to P4 is provided at the reference position Pst of the tool installation unit 9U, and the plurality of upper tools P1 to P4 installed on the tool installation unit 9U are moved to one side along the arrangement direction of the tools, so that the plurality of upper tools P1 to P4 are brought together at the fixing unit.

According to this method, by bringing the plurality of upper tools P1 to P4 together at the fixing unit, the plurality of upper tools P1 to P4 can be put together with respect to the reference position Pst. In a state before being brought together, it is not possible to specify where the plurality of upper tools P1 to P4 are located in the tool installation unit 9U. However, by putting the plurality of upper tools P1 to P4 together with respect to the reference position Pst, it is possible to recognize the positions of the plurality of upper tools P1 to P4.

Note that in the above-described embodiment, the upper tools P1 to P4 are brought together by using the pair of tool change units 13UL and 13UR. However, the tool change method according to the present embodiment may be a method of manually moving and putting together the upper tools P1 to P4 with respect to the reference position Pst. Furthermore, in the above-described embodiment, the first tool change unit 13UL is used as the fixing unit. However, in the tool change method according to the present embodiment, any object other than the first tool change unit 13UL may be used as long as the object regulates the movement of the upper tools P1 to P4.

Further, in the tool change method according to the present embodiment, the tool change units 13UL and 13UR that automatically perform tool change store, in the tool storage unit 17U, the plurality of upper tools P1 to P4 that have been brought together.

According to this configuration, since the positions of the plurality of upper tools P1 to P4 can be recognized, it is possible to automatically store, into the tool storage unit 17U, the plurality of upper tools P1 to P4 by the tool change units 13UL and 13UR.

In the above description, the embodiments have been described mainly for the automatic tool changer 13U corresponding to the upper table 5U, but the same applies to the automatic tool changer 13L corresponding to the lower table 5L.

The present invention is not limited to the above-described embodiments, and various modifications can be made without departing from the gist of the present invention.

The disclosure of the present application is related to the subject matter described in Japanese Patent Application No. 2019-087387 filed on May 7, 2019, all of which are incorporated herein by reference.

The invention claimed is:

1. A method of providing a plurality of bending tools to a tool storage unit, the method comprising:

placing a tool movement regulator, configured to regulate a movement of the tools, at a reference position;

moving the plurality of tools, the plurality of tools being installed on a tool installation, which moving moves the plurality of tools to one side in an arrangement direction of the tools that are installed on the tool installation;

bringing the plurality of tools together at the tool movement regulator;

calculating, by a control device configured to control an operation of a tool changer, the tool changer being the tool movement regulator, which tool changer automatically performs tool change of tools between the tool installation and the tool storage unit, a total sum of divided lengths of tools that should be on the tool installation based on layout information, wherein the layout information indicates information of the tools that should be on the tool installation;

when a length from the reference position to an end position of the plurality of tools that have been brought together does not coincide with the total sum of divided lengths, determining, by the control device, that there is some excess or deficiency of the plurality of tools that are installed on the tool installation;

acquiring, by the control device, tool information in which a tool ID is associated with an arrangement order for each of the plurality of tools that have been brought together; and controlling, by the control device, the tool changer to transfer the plurality of tools that have been brought together from the tool installation to the tool storage unit based on the acquired tool information.

2. The method of storing according to claim 1, further comprising, by the control device, acquiring the tool information for each of the plurality of tools that have been brought together via an acquirer capable of acquiring the tool information.

* * * * *